US006237558B1

(12) United States Patent
Ergezen et al.

(10) Patent No.: US 6,237,558 B1
(45) Date of Patent: May 29, 2001

(54) CRANKCASE FOR AN INTERNAL COMBUSTION ENGINE

(75) Inventors: Ugur Ergezen, Lieboch; Leopold Buchriegler, Weyer, both of (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 09/435,206

(22) Filed: Nov. 5, 1999

(30) Foreign Application Priority Data

Nov. 6, 1998 (AT) ..... 726/98 U

(51) Int. Cl.[7] ..... F02F 7/00
(52) U.S. Cl. ..... 123/195 R; 123/195 H
(58) Field of Search ..... 123/195 R, 195 H, 123/193.2

(56) References Cited

U.S. PATENT DOCUMENTS 4,582,028 * 4/1986 Wagner et al. ..... 123/41.82 R
4,773,366 * 9/1988 Seidl et al. ..... 123/196 R
4,876,998 * 10/1989 Wunsche ..... 123/198 E
5,107,809 * 4/1992 Suh ..... 123/195 H
5,868,110 * 2/1999 Betsch ..... 123/195 R

FOREIGN PATENT DOCUMENTS 314912 4/1974 (AT) .
398608 1/1995 (AT) .
2153258 8/1972 (DE) .
0463314 1/1992 (EP) .
0553069 7/1993 (EP) .
09137749 5/1997 (JP) .

* cited by examiner

*Primary Examiner*—Noah P. Kamen
*Assistant Examiner*—Hai Huynh
(74) *Attorney, Agent, or Firm*—Dykema Gossett PLLC

(57) ABSTRACT

A crankcase for an internal combustion engine, has main bearing walls including main bearing blocks, and side walls with skirtlike extensions, the side of each main bearing block being at least partially separated from the inner surfaces of the side walls by a recess, the recess having a curved contour, at least in sections, whose curvature increases continuously from the side face of the bearing block to the inner surface of the side wall to avoid critical stresses in the area of the main bearing block.

16 Claims, 1 Drawing Sheet

CRANKCASE FOR AN INTERNAL COMBUSTION ENGINE

BACKGROUND OF THE INVENTION

The invention relates to a crankcase for an internal combustion engine, with crankshaft main bearing walls including crankshaft main bearing blocks, and side walls with skirtlike extensions, the side of each main bearing block being at least partially separated from the inner surfaces of the side walls by a recess.

DESCRIPTION OF THE PRIOR ART

In AT 398 608 B a crankcase is described in which the main bearing blocks are partially stress-relieved by recesses running along the ribs of the crankcase so that the propagation of deformations due to gas or mass forces towards the side walls of the crankcase will be prevented. The recesses have a constant curvature at the point of maximum depth. The drawback of this design is that peak stresses due to the forces of the main bearing bolts and the gas force will accumulate in one point of the recess, which may lead to critical stress values.

SUMMARY OF THE INVENTION

It is an object of this invention to avoid the above disadvantages and reduce the stresses produced by mechanical loads in a crankcase of the above described type.

According to the invention this is achieved by providing the recess with a curved contour, at least in sections, whose curvature increases continuously from an inner section in the area of the side face of the main bearing block to an outer section in the area of the inner surface of the side wall. It is a special advantage if the contour has a larger curvature radius in at least one area of maximum mechanical stress resulting from gas forces essentially acting in the direction of the cylinder axis and/or forces arising from the main bearing bolts, than in areas which are subject to less mechanical load. Calculations have shown that it is possible in this way to reduce critical peak stresses resulting from the added stresses due to holding forces and gas forces. Whereas the zones of critical stress have maximum curvature radius, less critical areas may have a smaller curvature radius.

In order to keep the width of the recesses as small as possible even if the mechanical load is to be very small, the the contour has a curvature radius that is larger in an area at the side of the main bearing block than in the area of an inner surface of a side wall. The contour may have its smallest curvature radius in the area where the recess has its maximum depth.

Preferably, the contour of the recess at the point of maximum depth should be composed of at least two circular arcs with different radii, the arc next to the inner surface having the smallest radius. It may be provided in an enhanced variant of the invention that the contour is composed of at least three circular arcs with different radii.

It has been found that critical peak stresses can be optimally reduced if the contour, or at least sections thereof, assume the shape of a conic section, such as an ellipse, hyperbola or parabola. The conic section could be approximated by circles, i.e., oval arches for approximation of an ellipse. In short-stroke engines with small crankcase width the main axis of the conic section should advantageously form an angle with a parallel of the cylinder axis of about 0° ±60°, and preferably, 0° ±30°, preference being given to an embodiment wherein a vertex of the conic section on the main axis is positioned in or near the area of maximum depth of the recess, and more preferably on the side of the outer section.

If the contour, or at least sections thereof, assume the shape of an ellipse, the curvature radius of the inner section of the contour preferably corresponds to the curvature radius of the ellipse in the area of a small semi-axis.

In another low-stress variant of the invention the proposal is put forward that the contour, or at least sections thereof, be configured as a spiral line or involute.

BRIEF DESCRIPTION OF THE DRAWINGS

Following is a more detailed description of the invention as illustrated by the accompanying drawing, in which.

DETAILED DESCRIPTION OF PREFERRED EMBODIMENTS

Figure 1:
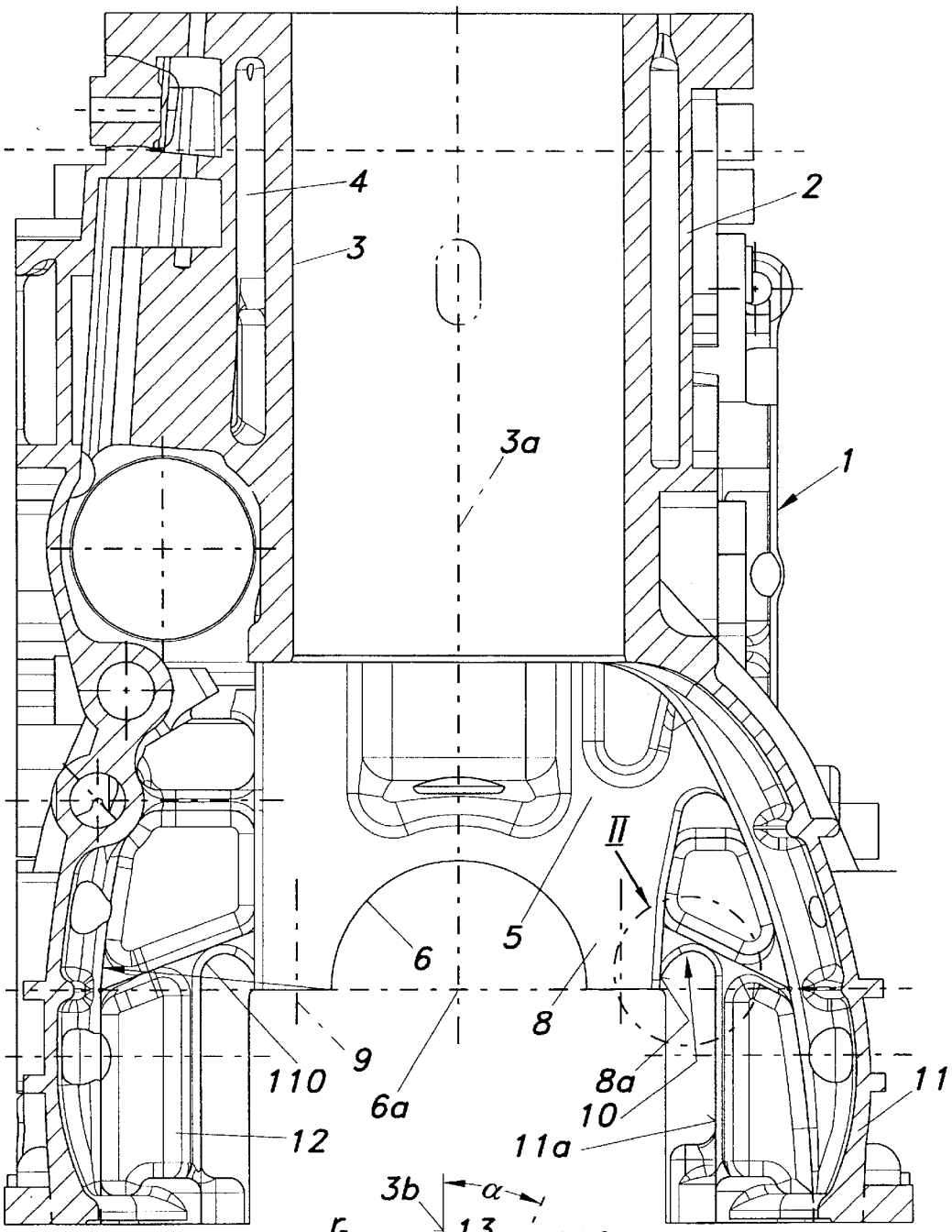
FIG. 1 shows the crankcase according to the invention, in a section through a cylinder.

The crankcase 1 of an internal combustion engine includes the cylinder part 2 for one or more cylinders 3, which are surrounded by a cooling jacket 4, and the main bearing walls 5, in which are located the crankshaft main bearings 6. The cylinder axes are referred to as 3*a*, whilst 6*a* is the crankshaft axis.

Reference number 9 refers to bores for bearing bolts which are used to fasten main bearing caps to the main bearing blocks 8.

The main bearing blocks 8, which are cast integral with the crankcase 1, are separated from the skirtlike side walls 11 of the crankcase 1 by recesses 10. For structural reinforcement the side walls 11 are provided with ribs 12 in the region of the main bearing walls 5, running essentially in the direction of the cylinder axis 3*a*.

In order to keep bending stresses at the recesses 10 as low as possible and to avoid a critical addition of peak stresses resulting from the holding force of the bearing bolts on the one hand and gas forces on the other hand, the curvature of the recesses 10 increases continuously from an inner section 113 to an outer section 112 in the area 13 of maximum depth T. In the simplest case the contour 110 of the recesses 10 in area 13 may be composed of two circular arcs with different radii $r_1$, $r_2$, where radius $r_1$ in the area of the inner surface 11*a* of the side walls 11 of the crankcase 1 is smaller than radius $r_2$ in the area of the side faces 8*a* of the main bearing blocks 8.

The area of the recess 10 on the side of the main bearing block 8, which is subject to the largest mechanical load, has the largest curvature radius $r_2$. The stresses arising in the area of the inner surfaces 11*a* of the side walls 11 of the crankcase 1 will be comparatively small, so that a smaller curvature radius $r_1$ may be used for the recess 10 on the side of the inner surfaces 11*a*, in order to keep the width of recess 10 as small as possible. Between radius $r_1$, and $r_2$ a transitional zone is provided whose radius is $r_3$.

The contour 110 of the recess 10, or at least parts thereof, may be configured as a conical section from the group of ellipse, hyperbola, parabola. Other geometric curves, such as spiral lines or involutes, are possible. Furthermore, the conic section could be approximated by circular arcs, such as oval arches.

Figure 2:
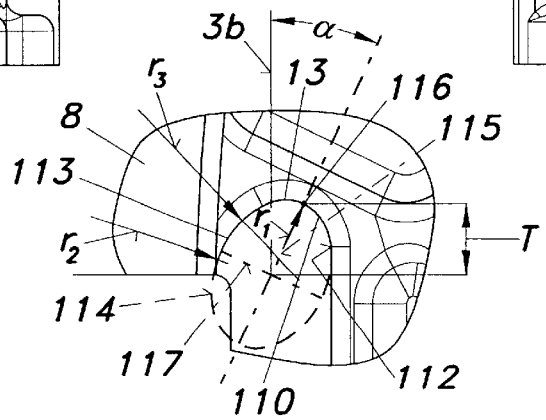
FIG. 2 shows detail II of FIG. 1.

In FIG. 2, for example, an ellipse 114 forming part of the contour 110 is shown, whose main axis 115 may form an angle a of 0° to 90° with the cylinder axis 3*a* or a parallel 3*b* of the cylinder axis 3*a*. In internal combustion engines with short stroke and small width the angle $\alpha$ should preferably amount to 0° ±60°, and more preferably 0° ±30°, the vertex 116 of ellipse 114 on the main axis 115 being positioned in the area of the inner surface 11*a* of the side wall 11. The smallest radius $r_1$ of the contour 110 is thus located in the area of the big main axis 115 of ellipse 114, the largest radius $r_2$ in the area of a small semi-axis 117.

In his way the addition of peak stresses arising from the bearing bolts and from the gas forces may be prevented and local overload will be avoided.

What is claimed is:

1. A crankcase for an internal combustion engine, with crankshaft main bearing walls including crankshaft main bearing blocks, and side walls with skirtlike extensions, the side of each main bearing block being at least partially separated from inner surfaces of the side walls by a recess, wherein the recess has a curved contour, at least in sections, whose curvature increases continuously from an inner section in the area of a side face of the main bearing block to an outer section in the area of the inner surface of the side wall.

2. The crankcase according to claim 1, wherein the contour has a larger curvature radius in at least one area of maximum mechanical stress resulting from gas forces essentially acting in direction of the cylinder axis and forces arising from main bearing bolts, as compared with areas which are subject to less mechanical load.

3. The crankcase according to claim 1, wherein the contour, or at least sections thereof, are configured as a spiral line or involute.

4. The crankcase according to claim 1, wherein the contour, or at least sections thereof, are configured as a conic section or approximated by a conic section.

5. The crankcase according to claim 4, wherein the conic section is approximated by circular arcs.

6. The crankcase according to claim 5, wherein the conic section is an ellipse, the ellipse being approximated by oval arches.

7. The crankcase according to claim 1, wherein the contour, or at least sections thereof, are configured as an ellipse, the curvature radius of the inner section of the contour corresponding to the curvature radius of the ellipse in the area of a small semi-axis.

8. The crankcase according to claim 1, wherein the contour has a curvature radius that is larger in an area at the side of the main bearing block than in the area of an inner surface of a side wall.

9. The crankcase according to claim 1, wherein the contour has its smallest curvature radius in an area where the recess has its maximum depth.

10. The crankcase according to claim 1, wherein a main axis of the conic section forms an angle with a parallel of the cylinder axis of about 0°±60°.

11. The crankcase according to claim 10, wherein a main axis of the conic section forms an angle with a parallel of the cylinder axis of about 0°±30°.

12. The crankcase according to claim 10, wherein a vertex of the conic section on the main axis is positioned in or near the top of the contour.

13. The crankcase according to claim 10, wherein the vertex of conic section on the main axis is positioned on the side of the outer section.

14. The crankcase according to claim 1, wherein the contour of the recess is composed of at least two circular arcs with different radii in the area of maximum depth, an arc next to the inner surface having the smallest radius.

15. The crankcase according to claim 1, wherein the contour is composed of at least three circular arcs with different radii.

16. A crankcase for an internal combustion engine, with crankshaft main bearing walls including crankshaft main bearing blocks, and side walls with skirtlike extensions, the side of each main bearing block being at least partially separated from inner surfaces of the side walls by a recess, wherein the recess has a curved contour, at least in sections, whose curvature increases continuously from inner section in the area of a side face of the main bearing block to an outer section in the area of the inner surface of the side wall and wherein the contour has a larger curvature radius in at least one area of maximum mechanical stress resulting from gas forces essentially acting in direction of the cylinder axis and forces arising from main bearing bolts, than in areas which are subject to less mechanical load.

* * * * *